US010152934B2

(12) United States Patent
Huang

(10) Patent No.: US 10,152,934 B2
(45) Date of Patent: Dec. 11, 2018

(54) GAMMA REFERENCE VOLTAGE GENERATION CIRCUIT AND DISPLAY DEVICE

(71) Applicant: Shenzhen China Star Optoelectronics Technology Co., Ltd., Shenzhen, Guangdong (CN)

(72) Inventor: Xiaoyu Huang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 115 days.

(21) Appl. No.: 15/305,345

(22) PCT Filed: Jul. 12, 2016

(86) PCT No.: PCT/CN2016/089752

§ 371 (c)(1),
(2) Date: Oct. 19, 2016

(87) PCT Pub. No.: WO2017/190429

PCT Pub. Date: Nov. 9, 2017

(65) Prior Publication Data

US 2018/0144701 A1 May 24, 2018

(30) Foreign Application Priority Data

May 4, 2016 (CN) ..... 2016 1 0288883

(51) Int. Cl.
*G09G 3/36* (2006.01)

(52) U.S. Cl.
CPC ..... *G09G 3/3648* (2013.01); *G09G 3/36* (2013.01); *G09G 2320/0276* (2013.01); *G09G 2320/0673* (2013.01)

(58) Field of Classification Search
CPC ..... G09G 3/3648; G09G 2320/0276; G09G 2320/0673
See application file for complete search history.

(56) References Cited

U.S. PATENT DOCUMENTS 6,639,244 B1 10/2003 Yamazaki
8,933,344 B2 1/2015 Jeon
(Continued)

FOREIGN PATENT DOCUMENTS

CN 1194039 A 9/1998
CN 101539696 A 9/2009
(Continued)

*Primary Examiner* — Charles Hicks
(74) *Attorney, Agent, or Firm* — Andrew C. Cheng

(57) ABSTRACT

A gamma reference voltage generation circuit and a display device are disclosed. The gamma reference voltage generation circuit includes a reference voltage generation unit; and multiple resistor units; wherein, the reference voltage generation unit is disposed on a printed circuit board; the multiple resistor units receive a reference voltage from the reference voltage generation unit and output a first gamma reference voltage; the multiple resistor units are formed at a region separated from the printed circuit board. The gamma reference voltage generation circuit of the present invention utilizes voltage-dividing resistors at a region outside the printed circuit board to reduce the space of the printed circuit board being occupied and reduce the manufacturing cost.

7 Claims, 3 Drawing Sheets

(56) References Cited

U.S. PATENT DOCUMENTS

| | | | | |
|---|---|---|---|---|
| 2008/0284929 | A1* | 11/2008 | Kimura | G02F 1/13624 349/38 |
| 2011/0057918 | A1* | 3/2011 | Kimura | G09G 3/3648 345/211 |

FOREIGN PATENT DOCUMENTS

| | | | |
|---|---|---|---|
| CN | 201876643 | U | 6/2011 |
| CN | 102315211 | A | 1/2012 |
| CN | 102645806 | A | 8/2012 |
| CN | 103886844 | A | 6/2014 |

* cited by examiner

GAMMA REFERENCE VOLTAGE GENERATION CIRCUIT AND DISPLAY DEVICE

BACKGROUND OF THE INVENTION

1. Field of the Invention

The present invention relates to a display field, and more particularly to a gamma reference voltage generation circuit and a display device including the gamma reference voltage generation circuit.

2. Description of Related Art

A display device is a necessary component for an electric product. The type of the display device includes a cathode ray tube display, a liquid crystal display and light-emitting diode device, and so on.

Adopting a thin-film transistor liquid crystal display (TFT-LCD) of the liquid crystal display as an example, the TFT-LCD has become a main type of the current display device relied on features of high contrast ratio, strong layering, bright colors, and has gradually become an important display way of the current IT and video product.

A display panel of the liquid crystal display device requires obtaining gamma reference voltages from external environment to display an image. Each gamma reference voltage corresponds to one grayscale level. Using grayscale voltages having different values to drive liquid crystals of sub-pixels of the liquid crystal panel to rotate in order to decide the transmittance (that is, the brightness) of the sub-pixels through the rotation angles of the liquid crystal molecules in order to achieve the purpose of grayscale displaying and image displaying.

The current gamma reference voltage generation circuit generates multiple gamma reference voltages through resistors or programmable gamma generation chip disposed on the printed circuit board (PCB). The multiple gamma reference voltages are connected to a display region of the display device after passing through a chip on film of source electrode side (S-COF) and traces of a fan-out region of the display device.

However, the current gamma voltage generation circuit requires a programmable gamma generation chip or a large number of voltage-dividing resistors so that a larger space of the PCB is occupied and consuming a large number of component cost and proofing cost in order to increase the manufacturing cost of the display device.

SUMMARY OF THE INVENTION

In order to overcome the drawbacks of the conventional art, the exemplary embodiment of the present invention provides a gamma reference voltage generation circuit and a display device, which can decrease the cost and save the space of the PCB.

According to one aspect of the present invention, providing a gamma reference voltage generation circuit, comprising: a reference voltage generation unit; and multiple resistor units; wherein, the reference voltage generation unit is disposed on a printed circuit board; the multiple resistor units receive a reference voltage from the reference voltage generation unit and output a first gamma reference voltage; the multiple resistor units are formed at a region separated from the printed circuit board.

Optionally, an amplification unit is further provided, the amplification unit is disposed on the printed circuit board, and the amplification unit amplifies the first gamma reference voltage in order to enhance a signal driving ability, and outputs a second gamma reference voltage.

Optionally, the region is a fan-out region of a display panel of a display device.

Optionally, each resistor unit of the multiple resistor units is a single resistor.

Optionally, between each two adjacent resistor units of the multiple resistor units, a signal output terminal is provided for outputting the first gamma reference voltage.

Optionally, the multiple resistor units are formed through a metal layer and a semiconductor layer of the fan-out region.

Optionally, the first gamma reference voltage or the second gamma reference voltage is connected to a display region of the display panel through a chip on film of source electrode side.

Optionally, the display device is a thin-film transistor liquid-crystal display.

According to another aspect of the present invention, providing a display device, comprising: a gamma reference voltage generation circuit, comprising: a reference voltage generation unit; and multiple resistor units; wherein, the reference voltage generation unit is disposed on a printed circuit board; the multiple resistor units receive a reference voltage from the reference voltage generation unit and output a first gamma reference voltage; the multiple resistor units are formed at a region separated from the printed circuit board.

The gamma reference voltage generation circuit according to the embodiment of the present invention can fully utilize the fan-out region of the display panel of the display panel in order to decrease the space of the PCB occupied by the resistors in the conventional art. The gamma voltage generation circuit according to an embodiment of the present invention can reduce the manufacturing cost of the display device.

BRIEF DESCRIPTION OF THE DRAWINGS

Through following to combine figures to describe in detail, the above, the other purposes, the features and benefits of the exemplary embodiment of the present disclosure will become clearer, wherein.

DETAILED DESCRIPTION OF THE PREFERRED EMBODIMENT

Figure 1:
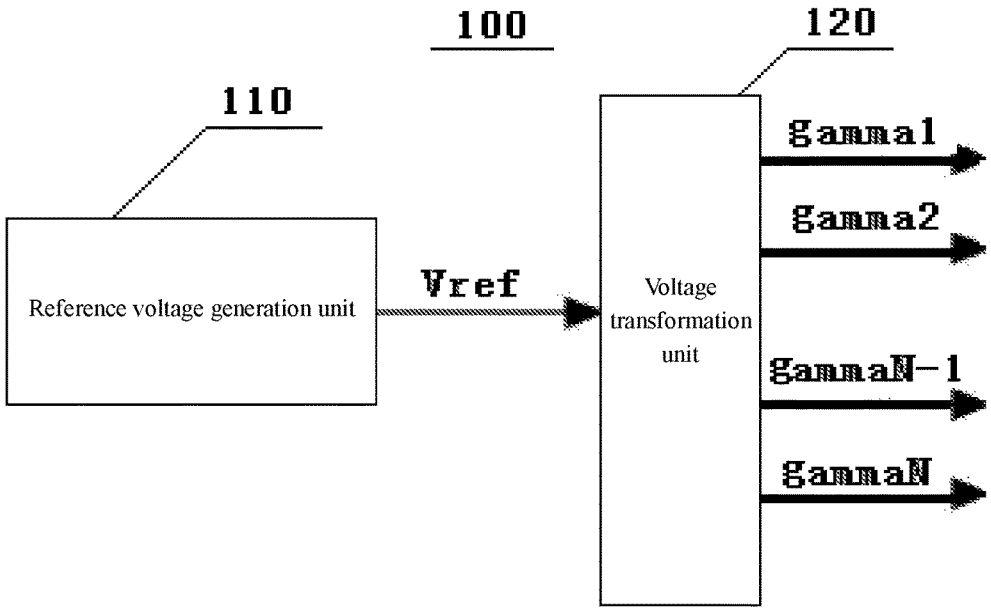
FIG. 1 (Prior art)
FIG. 1 and FIG. 2 are block diagrams of gamma reference voltage generation circuit.

The following will describe the exemplary embodiment of the present invention in detail, the example of the embodiment is shown in the drawings. Wherein, a same numeral represents a same device. The following will refer to the drawings to illustrate the embodiments in order to explain the present invention.

A gamma reference voltage generation circuit is mainly used for generating gamma reference voltages for driving the display device. The following will refer to FIG. 1 and FIG. 2 to describe the conventional gamma voltage generation circuit.

Figure 2:
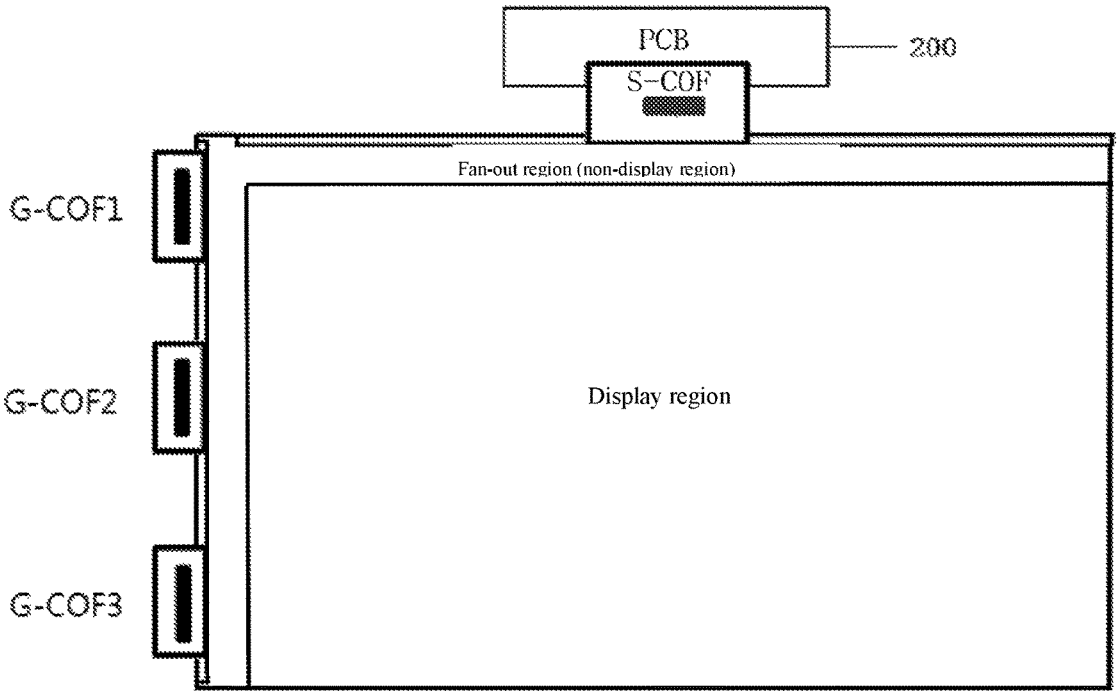
FIG. 2 (Prior art)

FIG. 1 and FIG. 2 are block diagrams of gamma reference voltage generation circuit.

With reference to FIG. 1, and FIG. 1 shows that a gamma reference voltage generation circuit 100 including a reference voltage generation unit 110 and a voltage transformation unit 120 disposed on the PCB. The reference voltage generation unit 110 provides a reference voltage Vref to the voltage transformation unit 120. The reference voltage Vref is converted to output multiple gamma reference voltages gamma1, gamma2, . . . , gammaN−1 and gammaN (N is usually 18 or 14) through the voltage transformation unit 120.

The multiple gamma reference voltages are respectively provided to a display region of the display panel of a display device (such as TFT-LCD) such that different grayscale voltages are used for driving the liquid crystals of sub-pixels.

Specifically, as shown in FIG. 2, the multiple gamma reference voltages gamma1, gamma2, . . . , gammaN−1 and gammaN generated by the gamma reference voltage generation circuit 100 disposed on the PCB 200 are connected to the display panel through the chip on film of source electrode side (S-COF), and after passing through traces of a fan-out region of the display panel, connected to the display region of the display panel such that each sub-pixel in the display region can obtain necessary power and signal.

The voltage transformation unit 120 shown in FIG. 1 is usually multiple voltage-diving resistors or a programmable gamma generation chip disposed on the PCB. When the necessary reference voltages are more, the necessary voltage-dividing resistors are more and an occupied space of the PCB is larger so that the component cost and the proofing costs are higher so as to cause a higher manufacturing cost.

According to an embodiment of the present invention, through disposing voltage-dividing resistors at a region outside the printed circuit board in order to reduce the space of the printed circuit board being occupied and reduce the manufacturing cost.

Figure 3:
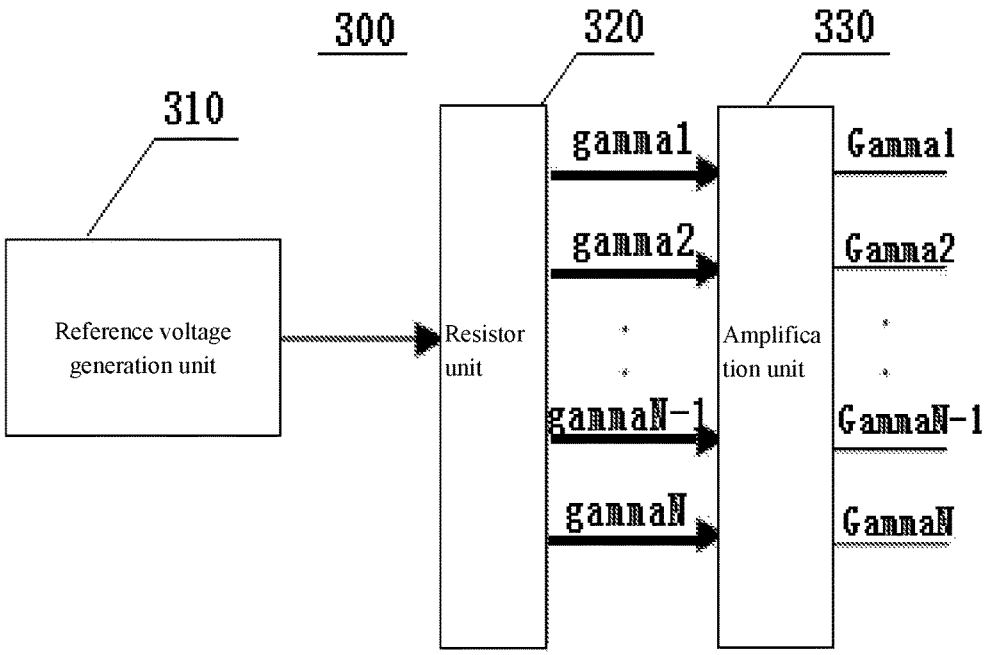
FIG. 3 and FIG. 4 are block diagrams of the gamma reference voltage generation circuit according to an embodiment of the present invention.
Figure 4:
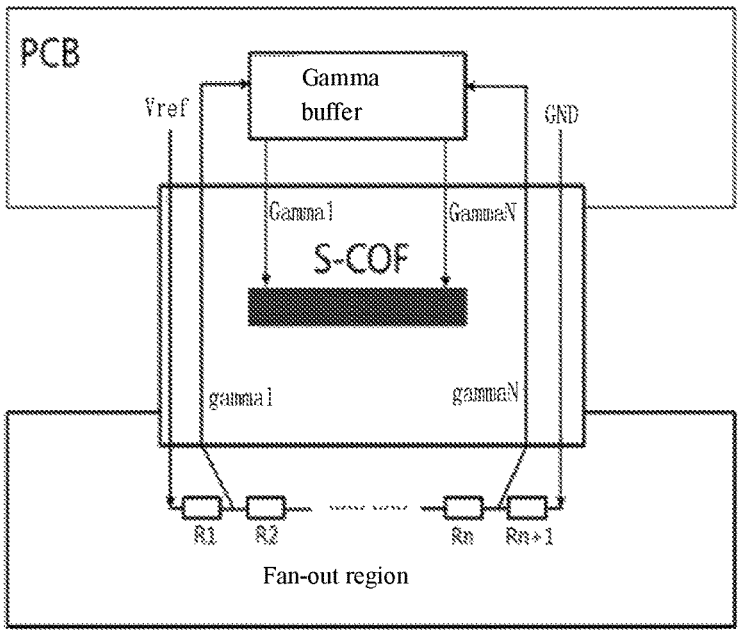
Figure 5:
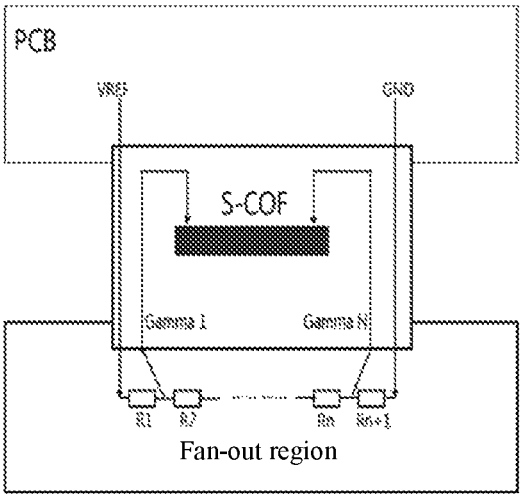
FIG. 5 is a block diagram of a gamma reference voltage generation circuit according to another embodiment of the present invention.

The following will refer to FIG. 3 to FIG. 5 to describe the gamma reference voltage generation circuit and a display device including the gamma reference voltage generation circuit of the embodiment of the present invention in detail.

FIG. 3 and FIG. 4 are block diagrams of the gamma reference voltage generation circuit according to an embodiment of the present invention.

As shown in FIG. 3, a gamma reference voltage generation circuit 300 according to an embodiment of the present invention includes a reference voltage generation unit 310, a resistor unit 320 and an amplification unit 330. The reference voltage generation unit 310 and the amplification unit 330 are disposed on the printed circuit board (PCB), and the resistor unit 320 is disposed on a region separated from the PCB. Optionally, the number of the resistor unit 320 can be multiple, and the multiple resistor units 320 can be used to perform a voltage-dividing to the reference voltage in order to output the gamma reference voltages. The amplification unit 330 is used for increasing a driving ability of the gamma reference voltages signal and also used as a gamma buffer. The multiple register units receive a reference voltage from the reference voltages generation unit 310 and output a first gamma reference voltages gamma1, gamma2 . . . gammaN−1 and gammaN. After the first gamma reference voltages passing through the gamma buffer, second gamma reference voltages Gamma1, Gamma2, . . . , GammaN−1 and GammaN is outputted. The second gamma voltage is provided to a display region of the display panel of the display device.

Specifically, as shown in FIG. 4, the multiple resistor units are formed on a fan-out region of the display panel separated from the PCB. The reference voltage Vref provided by the reference voltage generation unit is provided to the multiple resistor units. Optionally, the reference voltage Vref is connected to a terminal of the multiple resistor units, and the other terminal of the multiple resistor units is connected to a ground (GND, which is 0V). Between each two adjacent resistor units of the multiple resistor units, an output terminal is provided for outputting the first gamma reference voltage gamma1, gamma2 . . . gammaN−1 and gammaN. Optionally, each resistor unit of the multiple resistor units is a single resistor, and the multiple single resistors are connected to form the multiple resistor units.

According to a voltage-dividing principle of the resistor units:

$$\text{gammal} = Vref - \frac{Vref * R1}{(R1 + R2 + \ldots + Rn + 1)};$$

$$gammaN = Vref - \frac{Vref * (R1 + R2 + \ldots + Rn)}{(R1 + R2 + \ldots + Rn + Rn + 1)};$$

Through adjusting the resistance values of the resistor units, the first gamma reference voltages can be obtained. After the multiple first gamma reference voltages are buffered through the gamma buffer, the second gamma reference voltages Gamma1, Gamma, . . . , GammaN−1 and GammaN with enhanced driving ability are outputted to the display region (for example, transmitting to the display region after passing through the fan-out region) through the S-COF in order to drive the display panel to display an image.

FIG. 5 is a block diagram of a gamma reference voltage generation circuit according to another embodiment of the present invention.

FIG. 5 shows all components of the gamma reference voltages generation circuit shown in FIG. 4 except the gamma buffer. As shown in FIG. 5, if the first gamma reference voltages after being voltage divided by the multiple resistor units have enough driving force (that is, the driving ability), the amplification unit (such as gamma buffer) can be omitted. That is, the first gamma reference voltages after being voltage divided by the multiple resistor units can electrically connect to the display region of the display panel through S-COF.

Optionally, the multiple resistor units described in FIG. 3 to FIG. 5 are disposed on the fan-out region of the display panel separated from the PCB. For example, an ARRAY process can be used to form multiple resistor units by a metal layer and a semiconductor layer on the fan-out region in order to form the voltage-dividing resistors used for voltage dividing the reference voltage generated by the reference voltage generation circuit on the PCB in order to output multiple gamma reference voltages.

The gamma reference voltage generation circuit according to the embodiment of the present invention can fully utilize the fan-out region of the display panel of the display panel in order to decrease the space of the PCB occupied by the resistors in the conventional art. The gamma voltage generation circuit according to an embodiment of the present invention can reduce the component cost and the proofing cost in order to reduce the cost for manufacturing the circuit.

The display device according to the embodiment of the present invention can include the above gamma reference voltage generation circuit. Besides, the display device of the embodiment of the present invention can include another printed circuit board (such as a main board) and a display panel. The display panel can include a display region and a non-display region (for example, the fan-out region). The fan-out region on the non-display region corresponds to a data driver, and includes a metal layer and a semiconductor layer. An ARRAY process can be applied to the metal layer and the semiconductor layer in order to form the multiple resistor units described in FIG. 3 to FIG. 5. The multiple resistor units receive the reference voltage provided by the printed circuit board in order to output the gamma reference voltages. The display device of the embodiment of the present invention utilizes a region that is separated from the printed circuit board to form the voltage-dividing resistors in order to decrease the manufacturing cost of the display device.

The above embodiments of the present invention are only exemplary; however, the present invention is not limited. The person skilled in the art can combine or split the technology solution of the present invention in order to obtain a suitable result. In the technology range disclosed by the present invention, the above embodiments can be improved or replaced and should also be covered in the protection range of the present invention. Accordingly, the scope of the present invention is limited in the claims and the equivalents of the claims.

What is claimed is:

1. A gamma reference voltage generation circuit, comprising:

a reference voltage generation unit; and multiple resistor units;

wherein, the reference voltage generation unit is disposed on a printed circuit board; the multiple resistor units receive a reference voltage from the reference voltage generation unit and output a first gamma reference voltage; the multiple resistor units are formed at a region separated from the printed circuit board;

wherein the printed circuit board is connected to a display panel through a chip on film of source electrode side (S-COF);

wherein the multiple resistor units are disposed at a non-display region of the display panel, and the non-display region is connected with the S-COF;

the first gamma reference voltage is inputted into the S-COF and is electrically connected to a display region of the display panel through the S-COF.

2. The gamma reference voltage generation circuit according to claim 1, wherein, an amplification unit is further provided, the amplification unit is disposed on the printed circuit board, and the amplification unit amplifies the first gamma reference voltage in order to enhance a signal driving ability, and outputs a second gamma reference voltage, and the second gamma reference voltage is electrically connected to the display region of the display panel through the S-COF.

3. The gamma reference voltage generation circuit according to claim 2, wherein, each resistor unit of the multiple resistor units is a single resistor.

4. The gamma reference voltage generation circuit according to claim 3, wherein, between each two adjacent resistor units of the multiple resistor units, a signal output terminal is provided for outputting the first gamma reference voltages.

5. The gamma reference voltage generation circuit according to claim 2, wherein, the first gamma reference voltage or the second gamma reference voltage is connected to a display region of the display panel through a chip on film of source electrode side.

6. The gamma reference voltage generation circuit according to claim 2, wherein, the display device is a thin-film transistor liquid-crystal display.

7. A display device, comprising:

a display panel having a non-display region and a display region;

a gamma reference voltage generation circuit, comprising:

a reference voltage generation unit; and multiple resistor units;

wherein, the reference voltage generation unit is disposed on a printed circuit board; the multiple resistor units receive a reference voltage from the reference voltage generation unit and output a first gamma reference voltage; the multiple resistor units are formed at a region separated from the printed circuit board;

wherein the printed circuit board is connected to the display panel through a chip on film of source electrode side (S-COF);

wherein the multiple resistor units are disposed at the non-display region of the display panel, and the non-display region is connected with the S-COF;

the first gamma reference voltage is inputted into the S-COF and is electrically connected to a display region of the display panel through the S-COF.

* * * * *